US008567136B2

(12) United States Patent
Pendley et al.

(10) Patent No.: US 8,567,136 B2
(45) Date of Patent: Oct. 29, 2013

(54) RAIL MOUNTING SYSTEM FOR MOUNTING SKYLIGHTS AND THE LIKE TO RIB ELEVATIONS OF A RAISED RIB METAL PANEL ROOFING SYSTEM

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 13/777,283

(22) Filed: Feb. 26, 2013

(65) Prior Publication Data

US 2013/0167459 A1 Jul. 4, 2013

Related U.S. Application Data

(63) Continuation of application No. 13/771,746, filed on Feb. 20, 2013, which is a continuation of application No. 13/932,892, filed on Mar. 8, 2011, now Pat. No. 8,438,798, which is a continuation-in-part of application No. 12/572,176, filed on Oct. 1, 2009, now abandoned.

(60) Provisional application No. 61/102,333, filed on Oct. 2, 2008.

(51) Int. Cl.
*E04B 7/18* (2006.01)

(52) U.S. Cl.
USPC ..... 52/200

(58) Field of Classification Search
USPC ..... 52/200, 18, 72, 80.1, 90.1, 90.2, 91.1, 52/202, 19, 536, 537, 545
See application file for complete search history.

(56) References Cited

U.S. PATENT DOCUMENTS 3,521,414 A 7/1970 Malissa
3,791,088 A 2/1974 Sandow et al.

(Continued)

FOREIGN PATENT DOCUMENTS

GB 981948 2/1965
JP 2000336859 5/2000

(Continued)

OTHER PUBLICATIONS

FAA Facility, photos of skylight installation, 3 pages, Sacramento, CA, prior to 2007.

(Continued)

*Primary Examiner* — Mark Wendell
(74) *Attorney, Agent, or Firm* — Thomas D. Wilhelm; Wilhelm Law, S.C.

(57) ABSTRACT

A rail mounting system is provided for mounting and supporting skylights and/or other structures to rib elevations of a metal panel roofing system. The rail mounting system includes first and second side rails which can be mounted to the rib elevations of the metal panel roof. Each side rail includes a riser, an upper flange extending from the riser, and a bottom shoulder structure extending from the riser. The bottom shoulder structure can be mounted to a rib elevation of the roofing system. The upper flange provides a top bearing surface for supporting one side of a skylight, or run of skylights, or other structures, which are supported from the roof by the rail mounting system. The rib elevations to which the side rails are mounted provide structural support for the skylight or skylights supported thereon for substantially the entire length of the skylight or skylights or other supported structure.

11 Claims, 13 Drawing Sheets

(56) References Cited

U.S. PATENT DOCUMENTS

| | | | | |
|---|---|---|---|---|
| 3,828,494 | A | 8/1974 | Uhrhane et al. | |
| 3,967,423 | A | 7/1976 | Hammond | |
| 4,117,638 | A | 10/1978 | Kidd, Jr. et al. | |
| 4,123,883 | A | 11/1978 | Barber, Jr. et al. | |
| 4,155,206 | A | 5/1979 | Player | |
| 4,296,581 | A | 10/1981 | Heckelsberg | |
| 4,470,230 | A | 9/1984 | Weisner | |
| 4,520,604 | A | 6/1985 | Halsey et al. | |
| 4,543,753 | A | 10/1985 | Sonneborn et al. | |
| 4,559,753 | A | 12/1985 | Brueske | |
| 4,621,466 | A | 11/1986 | Sonneborn et al. | |
| 4,649,680 | A | 3/1987 | Weisner et al. | |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A | 8/1989 | Weisner et al. | |
| 4,941,300 | A | 7/1990 | Lyons, Jr. | |
| 4,986,039 | A | 1/1991 | Weisner | |
| 5,027,576 | A | 7/1991 | Gustavsson | |
| 5,323,576 | A | 6/1994 | Gumpert et al. | |
| 5,511,354 | A | 4/1996 | Eidson | |
| 5,522,189 | A * | 6/1996 | Mortensen et al. | 52/200 |
| 5,553,425 | A | 9/1996 | Sampson et al. | |
| 5,561,953 | A | 10/1996 | Rotter | |
| 5,896,711 | A | 4/1999 | McClure | |
| 5,960,596 | A | 10/1999 | Lyons, Sr. | |
| 6,079,167 | A | 6/2000 | Voegele, Jr. | |
| 6,151,838 | A | 11/2000 | Husein | |
| 6,640,508 | B2 | 11/2003 | Lindgren et al. | |
| 6,966,157 | B1 | 11/2005 | Sandow | |
| 7,043,882 | B2 | 5/2006 | Gumpert et al. | |
| 7,296,388 | B2 * | 11/2007 | Valentz et al. | 52/200 |
| 7,308,777 | B2 | 12/2007 | Sandow | |
| 7,395,636 | B2 | 7/2008 | Blomberg | |
| 7,712,279 | B2 | 5/2010 | McClure | |
| 7,721,493 | B2 | 5/2010 | Skov et al. | |
| 7,736,014 | B2 | 6/2010 | Blomberg | |
| 8,438,800 | B2 | 5/2013 | McLain et al. | |
| 8,438,801 | B2 | 5/2013 | McLain et al. | |
| 2004/0049996 | A1 | 3/2004 | Blomberg | |
| 2005/0204674 | A1 | 9/2005 | Marshall | |
| 2006/0191230 | A1 | 8/2006 | Gumpert | |
| 2007/0094984 | A1 | 5/2007 | McClure | |
| 2007/0101665 | A1 | 5/2007 | Sandow | |
| 2008/0040993 | A1 | 2/2008 | Valentz et al. | |
| 2008/0190050 | A1 | 8/2008 | McClure | |
| 2010/0162643 | A1 | 7/2010 | Blomberg et al. | |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-LITE daylighting panels, received Jun. 20, 2012, 1 sheet.

Cross-section of VP TUF-LITE PANEL—attached to the side of SSR rib, received Jun. 20, 2012, 1 sheet.

Cross-section of BUTLER LITE PANEL—attached to the side of MR24 rib, received Jun. 20, 2012, 1 sheet.

Siemens Building, photos of skylight installation, 6 pages, prior to 2007.

Daljcon, LLC., Butler Manufacturing, www.daljcon.com, Example of 6 Layer Standing Seam, printed Dec. 11, 2012.

* cited by examiner

RAIL MOUNTING SYSTEM FOR MOUNTING SKYLIGHTS AND THE LIKE TO RIB ELEVATIONS OF A RAISED RIB METAL PANEL ROOFING SYSTEM

CROSS REFERENCE TO RELATED APPLICATIONS

This application is a continuation of application Ser. No. 13/771,746 filed Feb. 20, 2013, which is a continuation of application Ser. No. 12/932,892 filed Mar. 8, 2011, which is a continuation-in-part of application Ser. No. 12/572,176 filed Oct. 1, 2009, which claims the benefit of U.S. Provisional Patent Application No. 61/102,333, filed Oct. 2, 2008, each of the above-mentioned applications being incorporated herein by reference in its entirety, and made a part hereof.

BACKGROUND OF THE INVENTION

1. Field of the Invention

The present invention generally relates to roof penetrating systems such as skylights on buildings, and more particularly relates to skylight and similar systems which are installed on metal panel roofs having rib elevations.

2. Description of Related Art

Various systems involving curb structures have heretofore been used for inserting skylights and smoke vents into metal panel roofs on buildings. The most commonly used skylighting systems are those which incorporate translucent or transparent layers held in a framework that penetrates the roof structure, so as to allow ambient daylight into the building.

In the past, roof penetrating installations have required a complex structure beneath the roofing panels in order to support a roof curb to which the skylight was attached. Skylight curbs are generally in the form of a preassembled box structure fixed within a roof cutout or opening. However, the retrofitting of such curb systems into existing roof structures is problematic.

U.S. Pat. No. 4,296,581, to Heckelsberg, issued Oct. 27, 1981, provides an example of a roofing structure of the type which is constructed of a series of metal panels having flanges that interlock when the panels are laid side by side and which are subsequently tightly seamed together to convert the individual panels into an integrated roof-forming membrane. This roof structure is mounted to the purlins in the roof with clips that permit the panels to expand or contract in response to temperature and pressure changes, thereby minimizing roof stressing.

U.S. Pat. No. 4,703,596, to Sandow, issued Nov. 3, 1987, and titled "Grid Skylight System", provides a grid skylight support apparatus that includes prefabricated grid row frames, each of which forms a number of connected beam supports which define a number of bays. Each bay has a skylight curb formed by the upper flanges of the beam supports to receive a preassembled skylight unit. The sides of each grid row frame provide a mating edge that can register with the mating edge of an adjacent grid row frame during assembly. The skylights have peripheral support skirts that register upon each bay and a light-transmitting skylight panel to cover the peripheral support. Cross gutters on each grid row frame, which are positioned between adjacent skylights, extend at an angle toward the mating edge of the grid row frame for carrying rainwater to a main gutter channel formed by field-assembly of the mating edges of two adjacent grid row frames. The main gutter channel includes a pair of longitudinally extending gutter sections, each of which has a main gutter channel surface with a lower elevation than the elevation of the cross flow channel. Fasteners assemble the grid row frame mating edges together in a continuous seal to prevent rainwater leakage at the mating edges of adjacent grid row frames.

U.S. Pat. No. 4,520,604, to Halsey, et al., issued Jun. 4, 1985, and titled "Skylight Structure", teaches a curb structure that is dimensioned to be passed through an opening in a roof and then attached in moisture impervious relation to the roof from within a building interior. A skylight assembly including a frame and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaw includes a channel which engages and is interlocked with the curb structure.

Other skylight systems, as contemplated in U.S. Pat. No. 4,470,230, by Weisner, provide a prefabricated skylight support curb that is formed to be a protective packaging for the skylight during shipment and then used as a curb for mounting the skylight in a roof. A prefabricated skylight support curb for supporting a skylight thereover has a bottom flange, angled upright sides, and a top lip around the top of the sides which form an opening through the curb. A skylight is adapted to cover the opening formed by the skylight support curb when the skylight is installed, and has a domed portion, an angled curb portion extending from the dome portion and a drip edge on the curb portion. The skylight curb portion is shaped to fit over a portion of the prefabricated skylight support curb. The skylight and skylight support curb are shaped so that they can nest together in stacks of skylights and curbs to protect the skylights during shipping and storing.

In another skylight system, as contemplated in U.S. Pat. No. 3,791,083, by Sandow, et al., prefabricated multiple dome units or skylights and composite thereof are provided, wherein each multiple dome unit has several domes of transparent or translucent material mounted together on a common frame, and wherein means are provided for assembling a plurality of such dome units into a composite thereof on a building, with the units lapped and inter-fitted so as to provide a continuous drainage system discharging to the exterior of the units in the composite assembly.

In yet another skylight system, as contemplated in U.S. Pat. No. 4,621,466, by Sanneborn, et al., a flashing frame is described for roof windows to be installed adjacent to each other with edges facing each other in the installed position. A connecting flange of the upper flashing members extends beneath the roofing and, if need be, with lower flashing members and required intermediary flashing members, obliquely outwardly bent connecting webs, each with a connecting bar with supporting webs which rearwardly engage the connecting webs, are adjacent the width of the installation distance and are obliquely bent inwardly on both sides. At least one inner projection engages between the facing corner edges of the connecting webs in the installed position, thus maintaining the corner edges at the installation distance.

In today's world of mandated energy efficiency in all types of buildings the metal building industry needs a more economical and less detrimental way to use skylights and smoke vents to daylight buildings. To ensure adequate daylighting, however, typical skylight and smoke vent installations require multiple roof penetrations that cut through and remove plural major elevations in standing seam and other raised rib metal panel roof profiles. Such curbs create multiple opportunities for water to enter the interior of the building, due to multiple curb locations and the widths of the curbs, as well as the challenge to effectively seal the roof at the upper ends of such curbs.

The traditional curb constructions and methods of attachment in most cases require a complicated support structure to be installed below the roof panel, which can restrict movement associated with the thermal expansion and contraction of the metal roof due to temperature changes and the like.

None of the prior approaches have been able to provide an installation system for multiple skylights that accomplishes all the goals of economy and simplicity of installation and that will work equally well for new buildings and as a retrofit in existing buildings.

SUMMARY OF THE INVENTION

The invention provides a rail mounting system for installing a skylight or other roof penetrating structure, such as a smoke vent, on the raised rib metal panel roofing system of a building; or installing two or more adjacent skylights and or other roof penetrating structures end to end on the raised rib metal panel roofing system of such building. The invention can be adapted to different metal panel roofing systems, including standing seam, snap seam, and "R" panel roof types, and can be mounted so that the system can move with the expansion and contraction of the roof.

In accordance with the invention, a rail mounting system for mounting a skylight or other structure accompanying a roof penetration on a metal roof system having panel flats, and rib elevations extending upwardly from the panel flats, comprises side rails for supporting each of opposing sides of a skylight or a run of skylights (or other structures, such as smoke vents, mounted over a roof penetration). Each side rail has first and second opposing sides, a length, and a thickness between the opposing sides. The side rails are mounted, optionally directly, to the rib elevations, preferably to next adjacent rib elevations, of the metal panel roof and take advantage of the inherent structural integrity of the seamed rib elevations to support the weight of the skylight unit or units.

In a first family of embodiments, the invention comprehends a rail mounting system for mounting a skylight or other structure requiring a roof penetration on a metal panel roofing system having panel flats, and rib elevations extending upwardly from the panel flats. The rail mounting system comprises side rails for supporting opposing sides of such skylight or other structure, each of the side rails having first and second opposing sides, a length, and a thickness between the opposing sides, and comprising a vertical riser portion or wall, an upper flange extending from the vertical riser portion and providing a top bearing surface for supporting one of the opposing sides of the skylight or other structure, and a bottom shoulder structure adapted for attachment to the rib elevation of the metal panel roofing system along substantially the entire length of a respective side rail, and wherein the side, rails of the rail mounting system can be attached to the rib elevations, with the rib elevations underlying and supporting the side rails at locations along substantially the entire lengths of the respective side rails.

In some embodiments, the bottom shoulder structure of each side rail comprises an elongate first mating surface which can mate with, and be mounted to, a corresponding elongate second mating surface on a respective rib elevation along substantially the entire length of the respective side rail, the first mating surface having a length, and a width greater than the thickness of the respective side rail.

In some embodiments, a side rail is configured such that only one side of a rib elevation of the roofing system can underlie, and mate with, the bottom shoulder of the respective side rail.

In some embodiments, a side rail is configured such that one side of a rib elevation of a standing seam panel roofing system can underlie, and mate with, the bottom shoulder of the respective side rail.

In some embodiments, the bottom shoulder structure comprises a first shoulder panel extending at a generally perpendicular angle from the vertical riser portion, and a second shoulder panel extending downwardly from the first shoulder panel.

In some embodiments, the vertical riser wall or portion has a top end and a bottom end and the upper flange extends from the top end of the riser portion.

In some embodiments, the vertical riser wall or portion has opposing first and second sides, and the upper flange extends laterally away from the first side of the riser wall or portion and the lower shoulder structure extends laterally away from the second opposing side of the riser wall or portion and laterally away from the upper flange.

In some embodiments, the vertical riser wall or portion is in the form of a substantially continuous riser wall extending from a first end of the respective side rail to a second opposing end of the respective side rail.

In a second family of embodiments, the invention comprehends a rail mounting system for mounting a skylight or other structure requiring a roof penetration directly to rib elevations of a metal panel roofing system having panel flats, the rib elevations extending upwardly from the panel flats. The rail mounting system comprises side rails for supporting opposing sides of a skylight or other structure, each of the side rails having a length and a thickness, and being comprised of a vertical riser wall having a top end and a bottom end, an upper flange at the top end of the riser wall, the upper flange providing a top bearing surface for supporting one of the opposing sides of the skylight or other structure, and a bottom shoulder structure at the bottom end of the vertical riser wall, the bottom shoulder structure conforming in shape to at least a portion of the rib elevation and being adapted for attachment to the rib elevation along substantially the entire length of the respective side rail, wherein the rib elevations to which the side rails of the rail mounting system are attached underlie, and provide support for, the side rails along substantially the entireties of the lengths of the side rails.

In some embodiments the bottom shoulder structure of the respective side rail is provided in a shape that substantially conforms to one side of the rib elevation of a standing seam panel roofing system.

In some embodiments, the upper flange extends at a perpendicular angle to the vertical riser wall to thereby provide a substantially horizontal top bearing surface for supporting one side of the skylight or other structure.

In some embodiments, rib elevations of the metal panel roofing system have an outside and an inside, and wherein each side rail is configured for being mounted to the outside of such rib elevation.

In a third family of embodiments, the invention comprehends a metal panel roofing system, comprising at least one roof eave, a roof ridge, roofing panels extending from the at least one roof eave to the roof ridge, the roofing panels forming a roof having elongate spaced rib elevations, defining seams at adjacent edges of the roof panels, and extending from the at least one roof eave toward the roof ridge, and panel flats between the rib elevations, a roof penetration in at least one panel flat of the roof between two of the rib elevations, side rails, each having a length, and being mounted to the rib elevations adjacent the roof penetration, wherein the rib elevations to which the side rails are mounted underlie, and provide support for, the side rails along substantially the entireties of the lengths of the side rails, and a skylight or other structure mounted to the side rails and extending over the roof penetration.

In some embodiments, the respective rib elevation has an outside surface, disposed outwardly of the respective seam and an inside surface, disposed inwardly of the respective seam, and wherein the side rails, optionally bottom shoulder structures of the respective side rails, are mounted to the outside surfaces of the respective rib elevations.

In some embodiments, each side rail is comprised of a vertical riser portion, an upper flange extending from the vertical riser portion and providing a top bearing surface for supporting the skylight or other structure, and a bottom shoulder structure adapted for being mounted to a respective rib elevation of the roof adjacent such roof penetration.

In some embodiments, the material of each side rail, and thus the side rail, itself, has a corresponding thickness, and wherein bottom shoulder structure of each side rail comprises an elongate first mating surface which can mate with, and be mounted to, a corresponding elongate second mating surface on a respective rib elevation along substantially the entire length of the respective side rail, the first mating surface having a length, and a width greater than the thickness of the respective side rail.

In some embodiments, the roofing system is a standing seam metal panel roofing system, and the bottom shoulder structure of each side rail is mounted to only one side of the respective rib elevation.

In some embodiments, the vertical riser portion has a top end and a bottom end and the bottom shoulder structure extends from the bottom end of the riser portion.

In some embodiments, the vertical riser portion of each side rail is in the form of a substantially continuous riser wall extending parallel to the top of the rib elevation.

In a fourth family of embodiments, the invention comprehends a rail mounting system for mounting a skylight or other structure accompanying a roof penetration on a metal panel roof system having panel flats, and rib elevations extending upwardly from the panel flats. The rail mounting system comprises side rails for supporting opposing sides of a skylight or other structure, each of the side rails having a length and being comprised of a vertical riser portion, an upper flange extending from the vertical riser portion, and a bottom shoulder structure extending laterally away from, and down from, the vertical riser portion, and adapted for being mounted to the rib elevation of such metal panel roof system, wherein the rib elevations to which the side rails are mounted underlie and support the side rails.

These and other features and advantages of this invention are described in, or are apparent from, the following detailed description of various exemplary embodiments of the apparatus and methods according to this invention.

The present invention will be further appreciated and understood when considered in combination with the following description and accompanying drawings. It will be understood, however, that the following description is by way of illustration and not of limitation. Certain changes and modifications can be made within the scope of the invention without departing from the spirit of the invention, and the invention includes all such changes and modifications.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

DETAILED DESCRIPTION OF THE INVENTION

Figure 1:
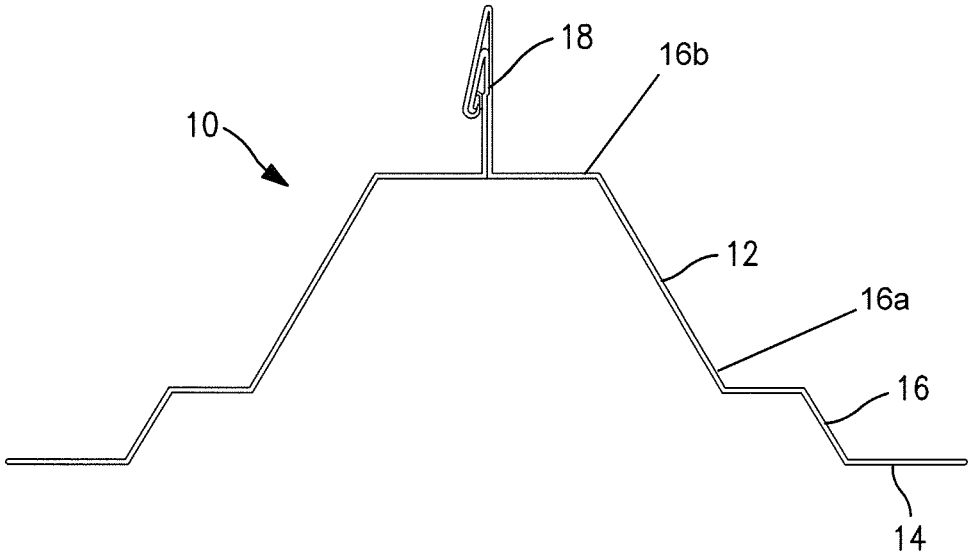
FIG. 1 PRIOR ART
FIG. 1 is a view showing a roof profile of a metal roof of the type known as the standing seam roof.

The present invention provides a rail mounting system for installing various roof penetrating structures in metal roofs. For purposes of simplicity, "roof penetrating structures" and "skylights" will be used interchangeably to mean various forms of roof structures installed for the passage of light and/or ventilation to the interior of a building through a penetration in the roof. In the case of roof ventilation, examples include simple ventilation systems, such as roof fans and smoke vents, which are used to allow the escape of smoke through the roof during fires.

The number of skylights can vary from one to many structures connected end-to-end, be it only one to as many skylights as the building roof structure will support, limited only by the amount of support provided by the roof surface structure, which is left largely intact during the installation process.

The system utilizes the major rib structure in the roof as the primary support structure and water barrier to fasten the skylight assembly. Typical skylight installations do not allow for continuous runs, but use a curb construction that is typically 2-3 times wider than the skylight and rail mounting system of the present invention.

The rail mounting system of the invention does not require a complex structure underneath the panels or a separate curb construction to support or attach the skylight. The rail mounting system of the invention is attached directly to the rib elevations of the metal roof panels and allows for thermal expansion and contraction by utilizing the rib elevations of the metal roof panels for support.

In reference now to the figures, in which like reference characters indicate like parts throughout the several views, the system allows the installation of two or more adjacent skylights in an end to end fashion along the major rib structure of a building's metal roof panel profile.

The skylight system may be applied to various types of ribbed roof profiles. FIG. 1 is a view showing the roof profile of a metal roof of the type known as the standing seam roof panel 10. These include the "standing seam" roof, which has trapezoidal major rib elevations 12 typically 24" to 30" on center. Each panel 10 includes the panel flat 14, a shoulder 16, including a shoulder incline 16*a* and a shoulder flat 16*b*, and a folded-over standing seam 18 which seams one panel to an adjacent panel to prevent water from penetrating the roof at the adjoining panel edges.

Figure 2:
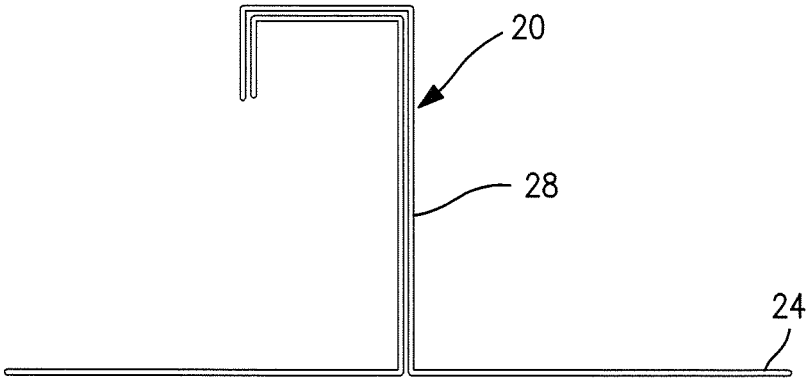
FIG. 2 PRIOR ART
FIG. 2 is a view showing a roof profile of a metal roof of the type known as an architectural standing seam panel roof.

FIG. 2 is a view showing the roof profile of a metal roof of the type known as an architectural standing seam roof, which is a series of overlapping architectural standing seam panels 20. Each panel 20 comprises a panel flat, 24, with an architectural standing seam 28 formed along the edges of the interconnecting panels, which presents a rib elevation type of structure. (As used herein, "rib elevation" shall mean any major structural elevation in the panel roofing system.)

Figure 3:
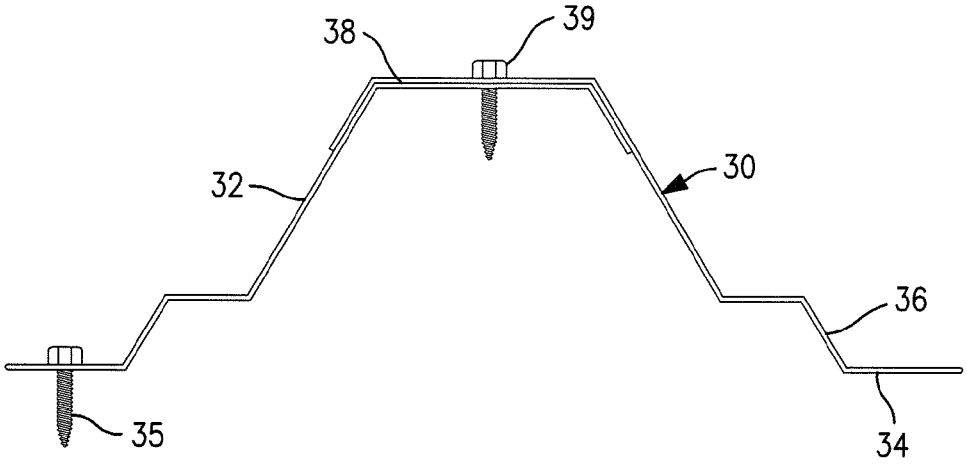
FIG. 3 PRIOR ART
FIG. 3 is a view showing a roof profile of a metal roof of the type commonly referred to as an exposed fastener panel roof.

FIG. 3 is a view showing the roof profile of a metal roof of the type commonly referred to as an R-panel or exposed fastener panel 30, with each panel having a rib elevation 32 and a panel flat 34. Adjacent R-panels are secured to the roof through the use of a structural fastener 35, and at the shoulder 36 which is formed from overlapping regions, or side lap 38. The adjacent panels are secured to each other through the use of a stitch fastener 39. The trapezoidal major rib elevations of the R-panel roof are most typically formed at 8" to 12" on center.

Figure 4:
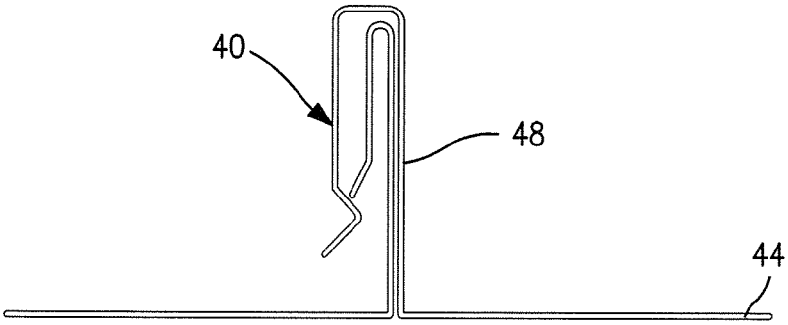
FIG. 4 PRIOR ART
FIG. 4 is a view showing a roof profile of a metal roof of the type commonly referred to as a snap seam panel roof.

FIG. 4 is a view showing the roof profile of a metal roof of the type commonly referred to as a snap rib seam panel 40. Snap seam panels 40 have a panel flat 44 and a standing seam or snap seam 48 at and along the edges of adjacent panels. Again, the snap seam provides a major structural elevation akin to a rib elevation.

Figure 5:
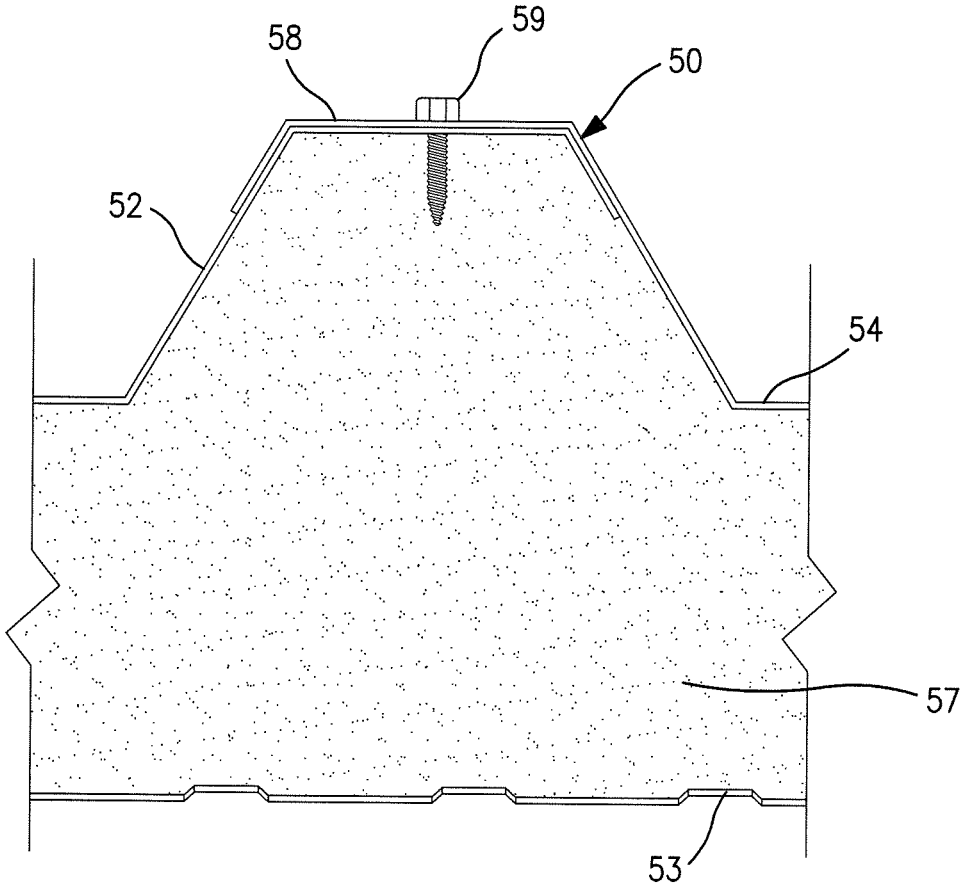
FIG. 5 PRIOR ART
FIG. 5 is a view showing a roof profile of a metal roof of the type commonly known as foam core panel roof.

FIG. 5 is a view showing the roof profile of a metal roof of the type commonly known as foam core panel 50, which has a rib elevation 52, a liner panel 53, a panel flat 54 and a foam core 57. Side laps 58 are secured by a stitch fastener 59. This panel is typically installed from the interior of the building.

The rail mounting system of the invention supports skylights on major structural elevations of the metal panel roof, which include seams, rib structures, or other elongated raised structural elements. The raised structural elements or rib elevations provide the structural support for supporting the skylight or skylights over an opening or penetration formed in the intervening, non-structural flat region of the roof panels.

Figure 6:
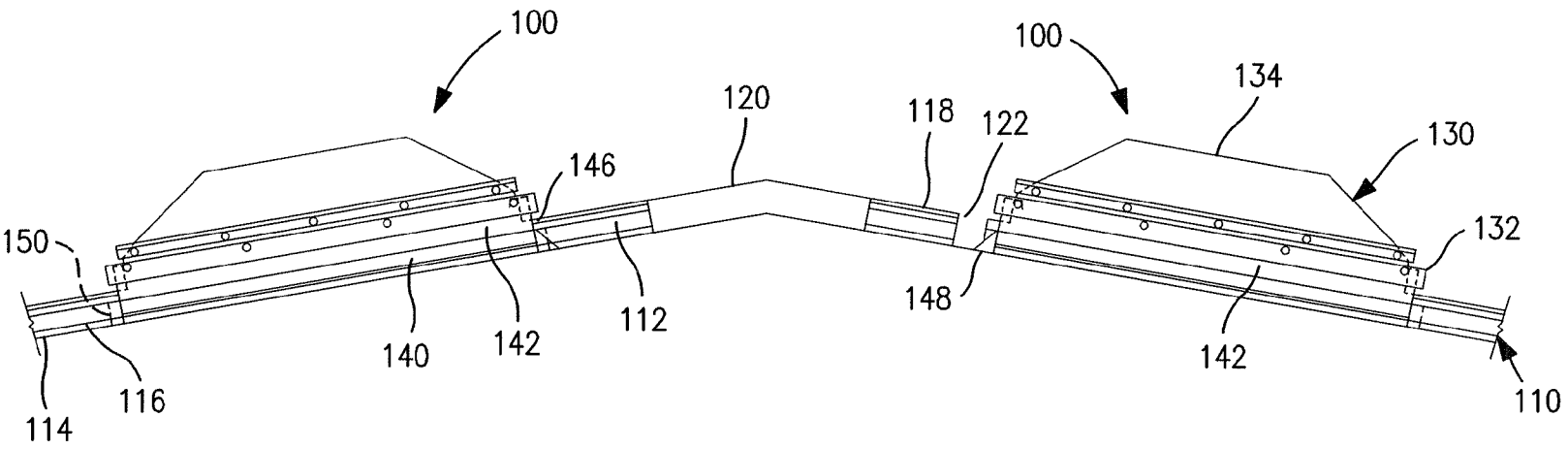
FIG. 6 is a side elevation view of two skylights installed on a metal roof using a rail mounting system in accordance with the invention.
Figure 7:
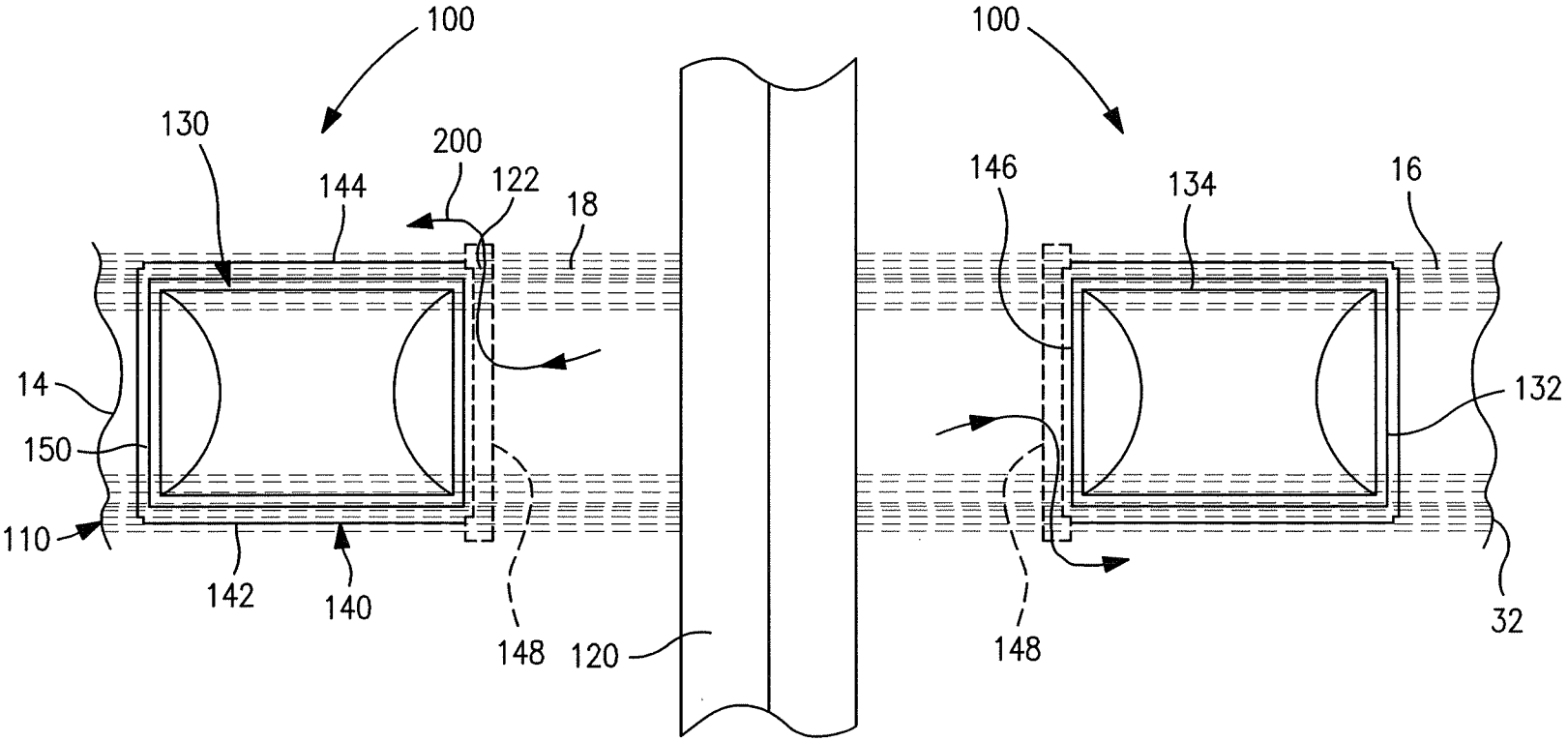
FIG. 7 is a plan view of the skylights of FIG. 6, showing the placement of the skylights and the direction of flow of water over the roof.

Turning now to FIGS. 6 and 7, there is shown an exemplary skylight and rail mounting system 100 adapted for attachment to a standing seam panel roof 110. While the figures depict the skylight and rail mounting system mounted to a standing seam metal panel roof, it will be understood that the rail mounting system components could easily be adapted, by suitably shaping its components, for attachments to the major structural elevations of any roof system where the structural elevations have different characteristic profiles.

Referring again to the figures, and particularly FIGS. 6 and 7, the standing seam metal panel roof 110 is seen to have raised ribs or rib elevations 112 and a panel flat 114 extending between the rib elevations. Each rib elevation includes a raised shoulder 116 and a standing seam 118. Also depicted is the ridge cap 120 of the metal panel roof.

The skylight and rail mounting system 100 includes a skylight 130, which is comprised of a skylight frame 132 and skylight lens 134. While the figures depict a skylight, it will be understood that the rail mounting system, denoted by numeral 140, of the skylight and rail mounting system 100 also could be adapted for use with any number of roof penetrating structures, from various types of skylights to smoke vents or other ventilating structures.

The rail mounting system 140 is comprised of side rails 142 and 144, which are further described below. These side rails prevent water intrusion through the sides of the skylight and rail mounting system 100. In order to prevent water intrusion at the relatively up-slope end of the skylight and rail mounting system, an upper diverter 146 is disposed between the adjacent rib elevations 112 of the metal panel roof 110 at the relatively up-slope ends of the side rails 142, 144. A rib cutaway region, or gap 122, in one of the rib elevations 112 is provided at the relatively up-slope ends of the side rails so that water that collects at the relatively up-slope end of the skylight and rail mounting system can be diverted by diverter 146 onto an adjacent roof panel. A plate 148 may be located under gap 122 to prevent water leakage through the roof. When installing the side rails and upper diverter to a roof, the plate 148 may be sealed and fastened securely to the roof panel supports.

FIG. 7 shows how gap 122 in one of the roof rib elevations 112 allows water flow 200 to occur along the roof surface, over plate 148, and down and away from the roof ridge cap 120.

A lower closure 150 may be provided between the rib elevations 112 at the relatively downwardly disposed ends of side rails 142, 144 to prevent water intrusion at the relatively downwardly disposed end of the skylight and rail mounting system 100.

Figure 8:
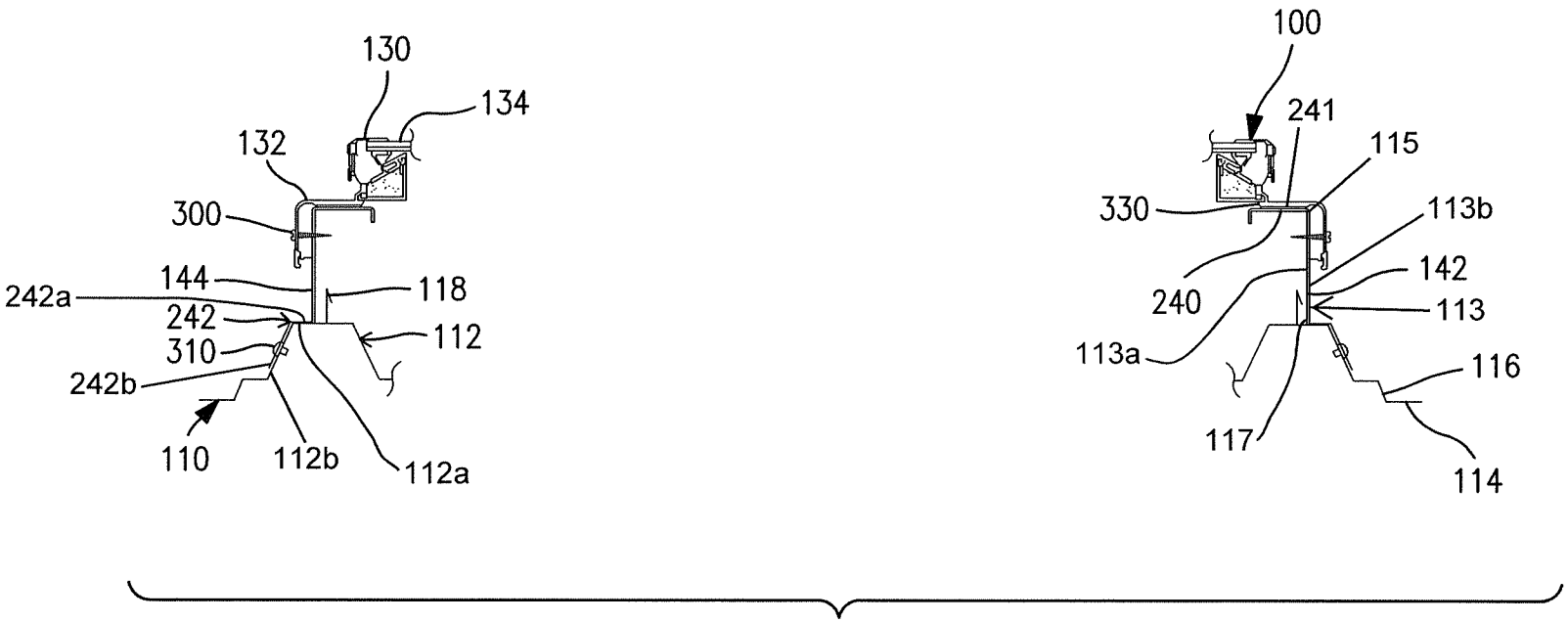
FIG. 8 is a fragmentary cross sectional view of a portion of a metal roof and one of the skylights shown in FIGS. 6 and 7, showing the adjacent rib elevations of the metal roof, the side rails of the rail mounting system attached to the outside of the rib elevations relative to the skylight, and the side edges of the skylight supported on the side rails.

Referring now to FIG. 8, there is shown a cross section of the skylight and rail mounting system 140, showing the securement of the side rails 142, 144 of the rail mounting system to standing seam panel roof 110. In particular, FIG. 8 depicts the use of the rib elevations 112 to support the side rails 142, 144. It is seen that each side rail 142, 144 has an upstanding, optionally vertical, riser portion, suitably a riser wall 113, having a first side 113*a* and a second opposing side 113*b*. An upper flange 240, which provides a top and suitably horizontal bearing surface 241, extends laterally from the first side 113*a* of the riser wall and most suitably from its top end 115 and extends toward the other of side rails 142, 144. As illustrated in FIG. 8, upper flange 240 provides a supporting interface for supporting the overlying load. A bottom shoulder structure 242 has a first surface facing in a direction having a downward-facing vector, and a second opposing surface. The bottom shoulder extends laterally from the second opposing side 113*b* of the riser wall, most suitably from its bottom end 117, extending away from the other of side rails 142, 144. Bottom shoulder structure 242 includes a first shoulder panel 242*a* extending laterally at a generally perpendicular angle from the riser wall and interfacing with shoulder flat 16*b* of the underlying rib shoulder element. A second shoulder panel 242*b* extends in a different downward direction from the distal end of the first shoulder panel and interfaces with shoulder incline 16*a* of the underlying rib shoulder element.

At least one of shoulder panels 242*a*, 242*b* defines a first elongate mating surface having a length, and a width greater than the thickness of the rail material, which first mating surface can mate with, and be attached to, a corresponding second elongate mating surface, 112*a* or 112*b*, on the respective rib elevation along substantially the entire length of the respective side wall.

The side rails 142 and 144 are secured to the skylight frame 132 by fasteners 300 spaced along the length of the respective side rail.

The bottom shoulder structure 242 of the side rail is shaped to fit closely over the outside contour of the roof rib 112, such as at panels 242*a* and 242*b*, and can be secured to roof rib 112 by rivets 310 which are spaced along the length of the respective side rail, whereby the rib structures support the side rails along substantially the entire lengths of the side rails, thus providing support at least at spaced locations, optionally continuous locations, along most, optionally all, of the lengths of the side rails, including along the sides, which extend between the corners, of the skylight or other structure which is being supported on the rail mounting system. The rail bearing surface 241 which suitably can be a horizontal surface, allowing for slope of the roof, supports the skylight frame 132, and a sealant 330 can be applied to this surface to seal against the passage of water or air.

It can be seen that the bottom shoulder structures of the side rails 142, 144 of the rail mounting system 140 can be shaped to fit closely along the contour of the rib elevations 112 of panel roof 110. The various mating surfaces of the side rails 142, 144 and rib elevations 112 can be sealed in various ways known to the roofing art, including caulking or tape mastic, or various rubber fittings or inserts can be used to seal the open area of the panel roof.

Figure 9:
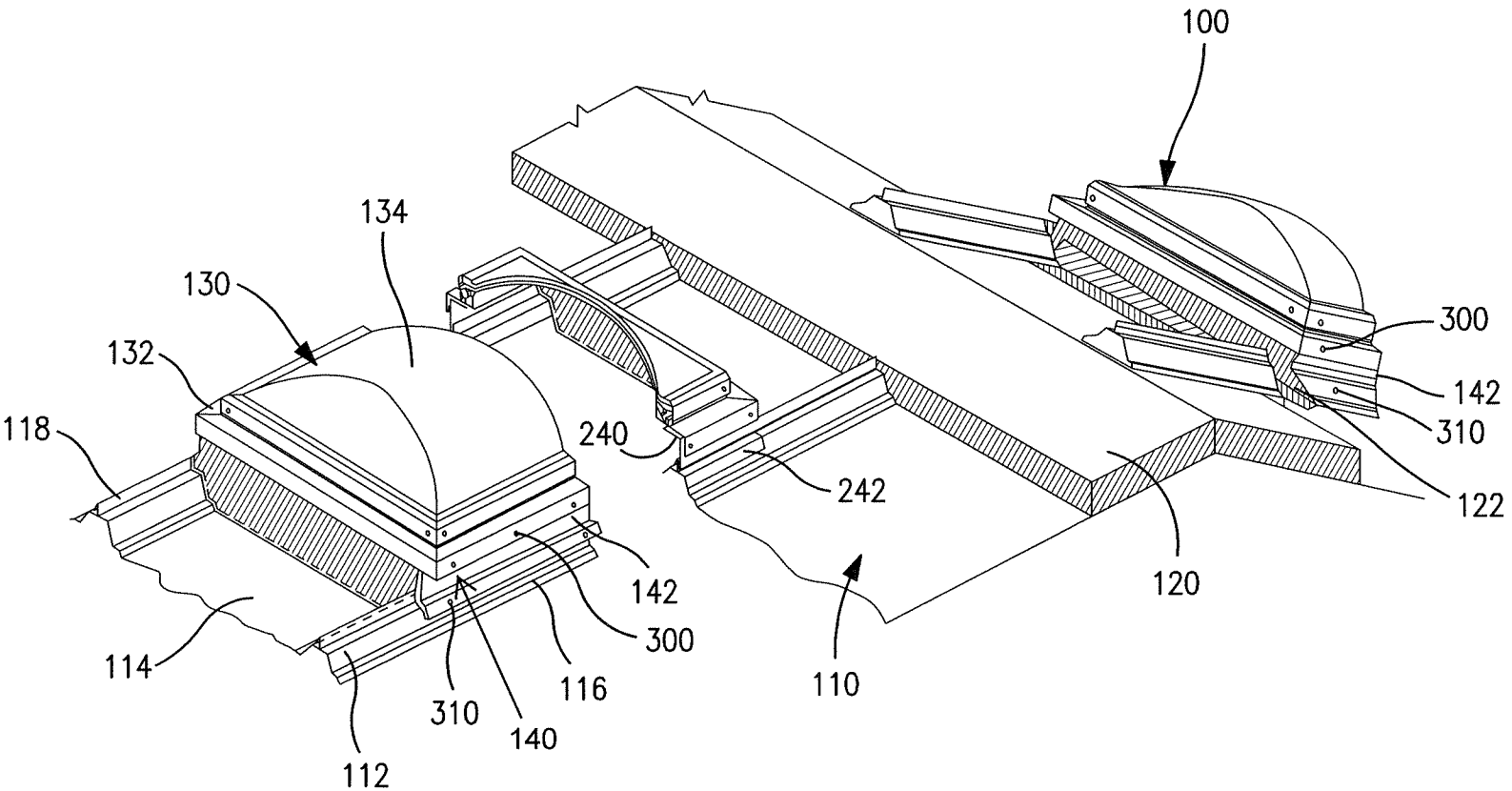
FIG. 9 is a perspective and partially cut away view of the skylights, the metal roof, and the rail mounting system shown in FIGS. 6 and 7.

In FIG. 9, a partially cut away perspective view of the skylight and rail mounting system 100 shows the support of the rail mounting system by the standing seam panel roof 110, and particularly shows the seamed elevated ribs 112 which provide the structural support for the skylight 130. FIGS. 8 and 9 show how the rail mounting system 140 interacts with the structural profiles of the rib elevations of metal roofs and how the rib elevations and side rails are used to prevent water intrusion from adjacent panels.

Most standing seam roofs are seamed using various clip assemblies that allow the roof to float, along the major elevation. Typically, the roof is fixed at the eave and allowed to expand and contract relative to the ridge. Very wide roofs can be fixed at mid-span and expand toward both eave and ridge. The design of the skylight and rail mounting system 100 takes full advantage of the floating features of contemporary roofing structures. When a skylight 130 is secured to the rib elevations by side rails 142, 144 of the rail mounting system, the full weight of the skylight is supported by the structural load bearing capacity of the seamed rib elevations.

Shown in FIG. 9 is the panel flat 114, rib elevation 112 and shoulder 116, as well as the standing seam 118. The ridge cap 120 is also shown, as well as the gap 122 in the roof. The skylight 130 is supported on the side rails 142, 144 of the rail mounting system 100, as previously described.

In FIG. 9, the skylight frame 132 is fastened to the side rails 142, 144 of the rail mounting system by a series of fasteners 300 spaced along the lengths of the sides of the skylight frame and the side rails; and the side rails in turn are fastened to the rib elevations 112 by a series of rivets 310 spaced along substantially the entire lengths of the side rails.

In application, a single rib elevation 112 is typically cut away (gap 122) at the relatively upper end of the rail mounting system 140 to accommodate drainage at the relatively upper end (toward ridge cap 120) of the skylight or run, of skylights where the high end diverter 146 is located. This is an important feature for standing seam, architectural standing seam and snap seam roofs. Two ribs may be cut for roofs having an R-panel profile.

The folded-over standing seamed portion 118 of the rib elevations 112 serve a dual purpose, namely both as a beam to support the side rails 142 and 144 and maintain a watertight seal along the lengths of the rib elevations. Internal portions of the rib elevations 112, namely portions of shoulders 116, may be removed to allow additional light from the skylight 130

A single bearing plate structure 148 (FIGS. 6 and 7) is used for sealing against water intrusion at the cut away rib. The bearing plate 148 also provides some support to link adjacent rib elevations 112 to each other, and is typically produced of steel or other material sufficient to provide a rigid substructure for the skylight.

The side rails 142, 144 of the rail mounting system 140 are shaped in such a manner that the skylight frame can be easily fastened directly to the side rails with rivets or fasteners such as screws and the like. The side rails may also be designed to accept a safety security guard before the skylight is installed.

Figure 10:
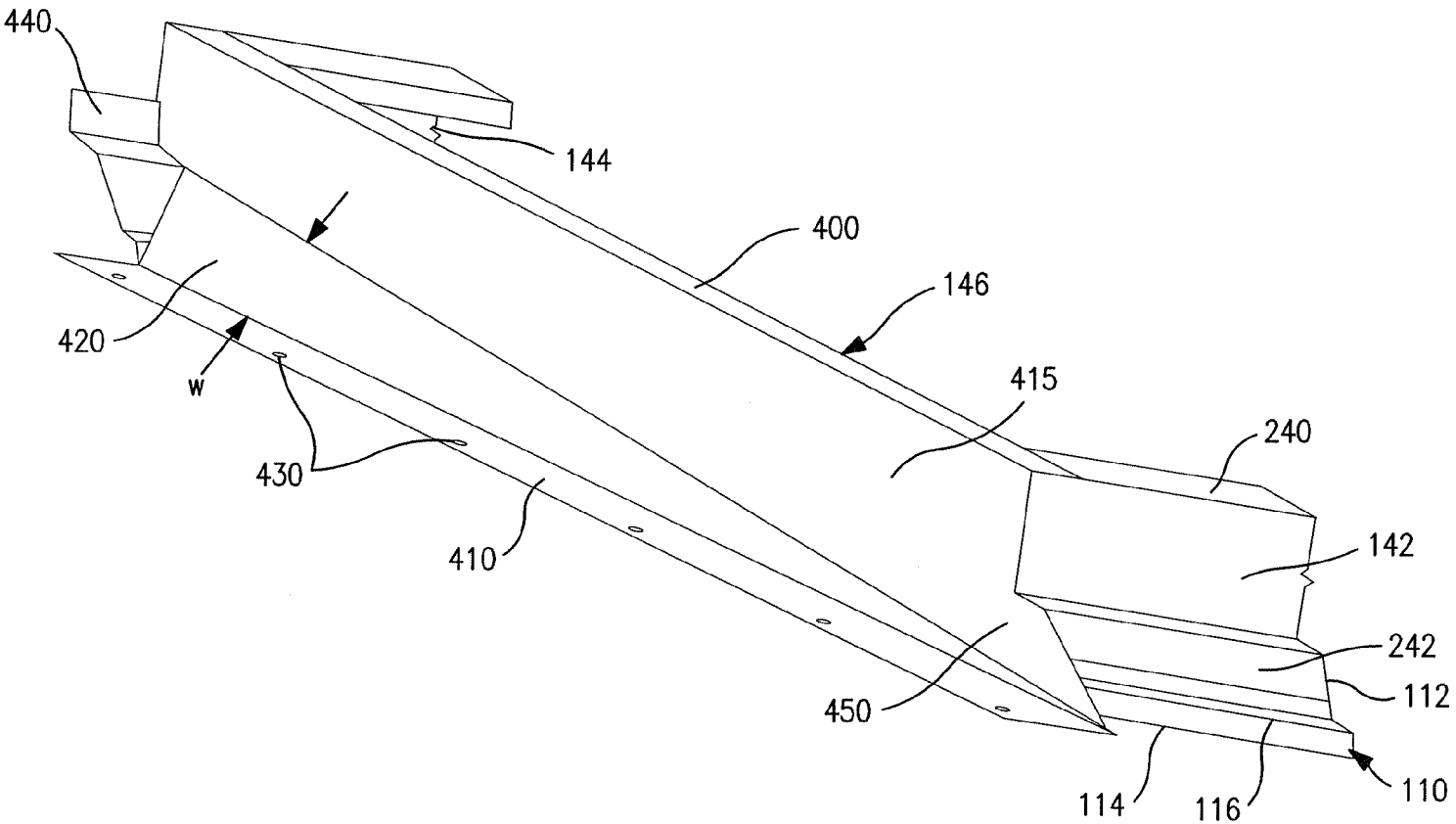
FIG. 10 is a top perspective view of an upper diverter used in the skylight installation shown in FIGS. 6, 7, and 9.
Figure 11:
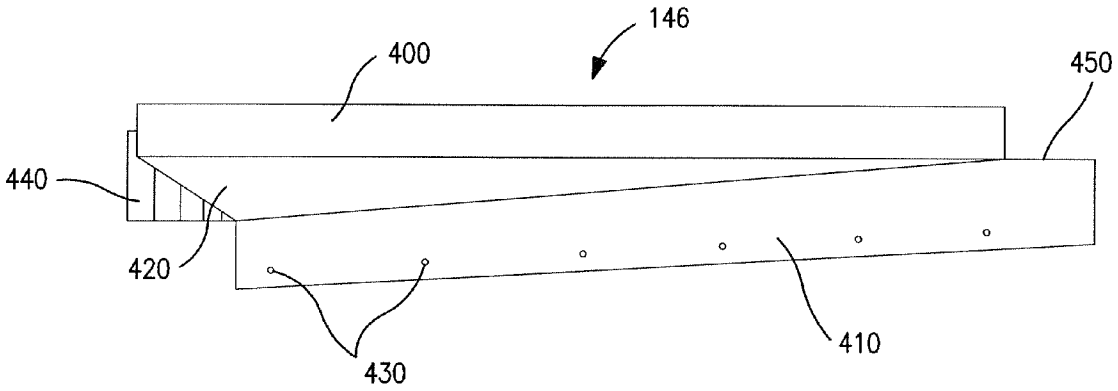
FIG. 11 is a plan view of the upper diverter of FIG. 10.
Figure 12:
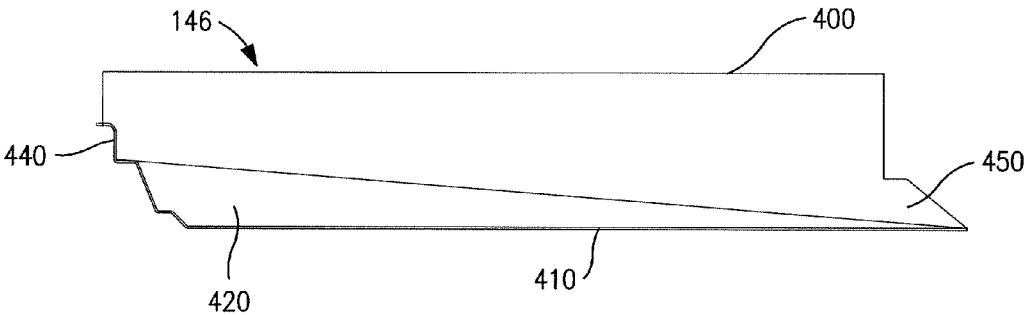
FIG. 12 is a front elevation view of the upper diverter of FIG. 10.

Referring to FIGS. 10 through 12, an upper or high end diverter 146 provides closure at the relatively upper end of the skylight and rail mounting system, and also provides diversion of water through gap 122 to an adjacent panel flat. Diverter 146, in combination with bearing plate 148, also provides a weather tight seal at the relatively upper end of the skylight and rail mounting system. In reference to the rib elevations 112 of the standing seam panel roof 110, diverter 146 generally fits the profile of the rib at the region of the cut away gap 122. The diverter 146 abuts side rails 142 and 144 and the height of the diverter closely matches the height of the side rails. The upper flange 400 of the diverter 146 acts with the upper flanges 240 of the side rails 142 and 144 to form the bearing surface of the skylight frame.

The lower flange 410 of diverter 146 runs along the panel flat 114. The diverter 146 also has a diversion surface 420 and fastener holes 430 along its lower flange. At one end of the diverter is a rib mating surface 440 and at the other end is a rib sealing plate 450.

Figure 13:
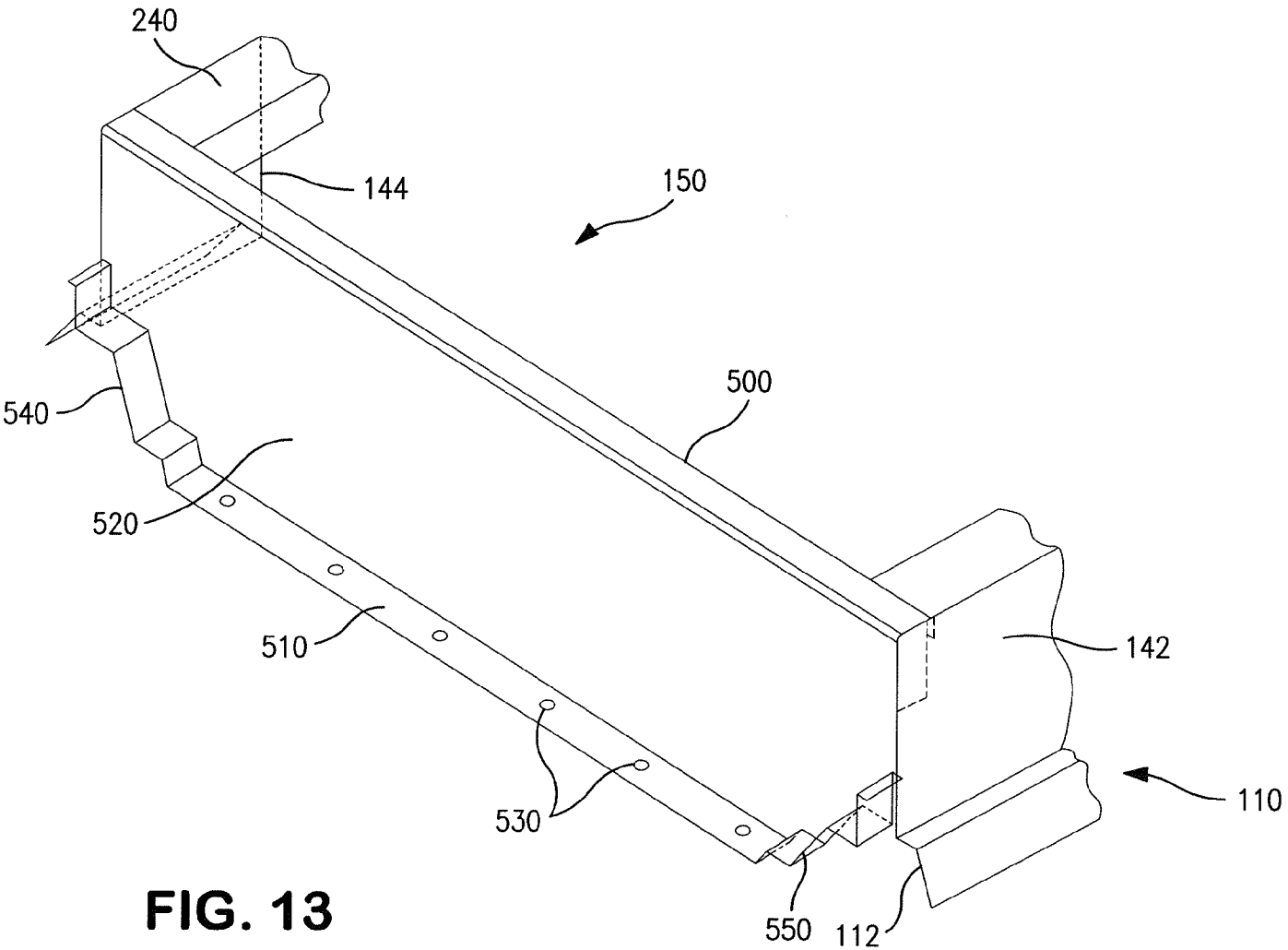
FIG. 13 is a top perspective view of the lower closure used in the skylight installation shown in FIGS. 6, 7, and 9.
Figure 14:
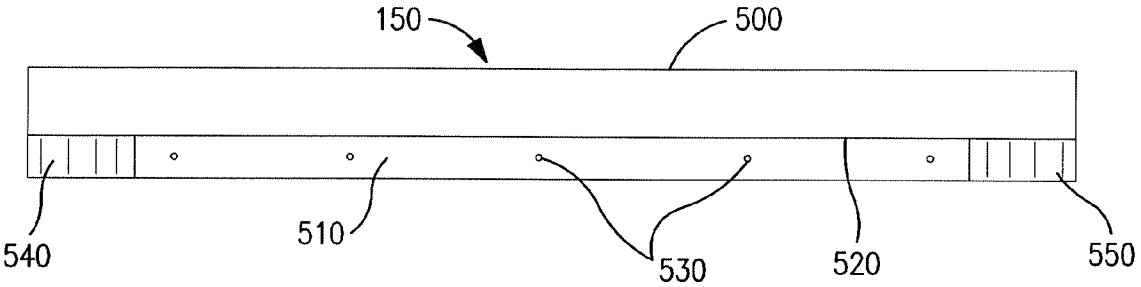
FIG. 14 is a plan view of the lower closure of FIG. 13.
Figure 15:
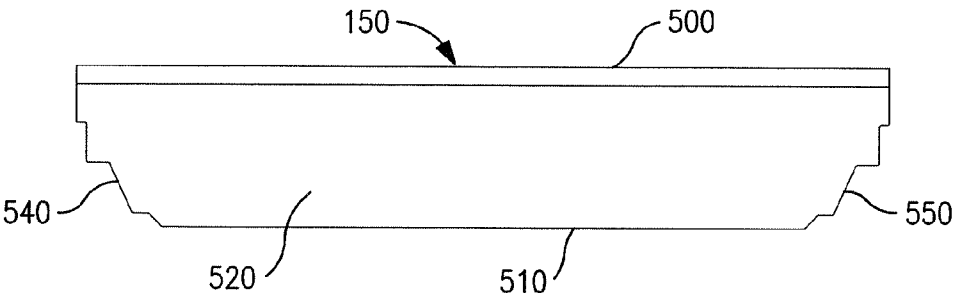
FIG. 15 is a front elevation view of the lower closure of FIG. 13.

FIGS. 13 through 15 show the lower end closure 150 that is used to maintain a weather tight seal at the lower end of the skylight and rail mounting system 100. Closure 150 is adapted to fit the profiles of the rib elevations 112. The ends of closure 150 abut side rails 142, 144 and the height of lower closure 150 matches the heights of the side rails.

Looking at lower closure 150, it is seen to have an upper flange 500 and a lower flange 510, as well as a closure web 520. The lower flange 510 includes fastener holes 530.

The lower closure 150 also includes rib mating surfaces 540 and 550 to provide a tight it along the ribs 112.

Figure 16:
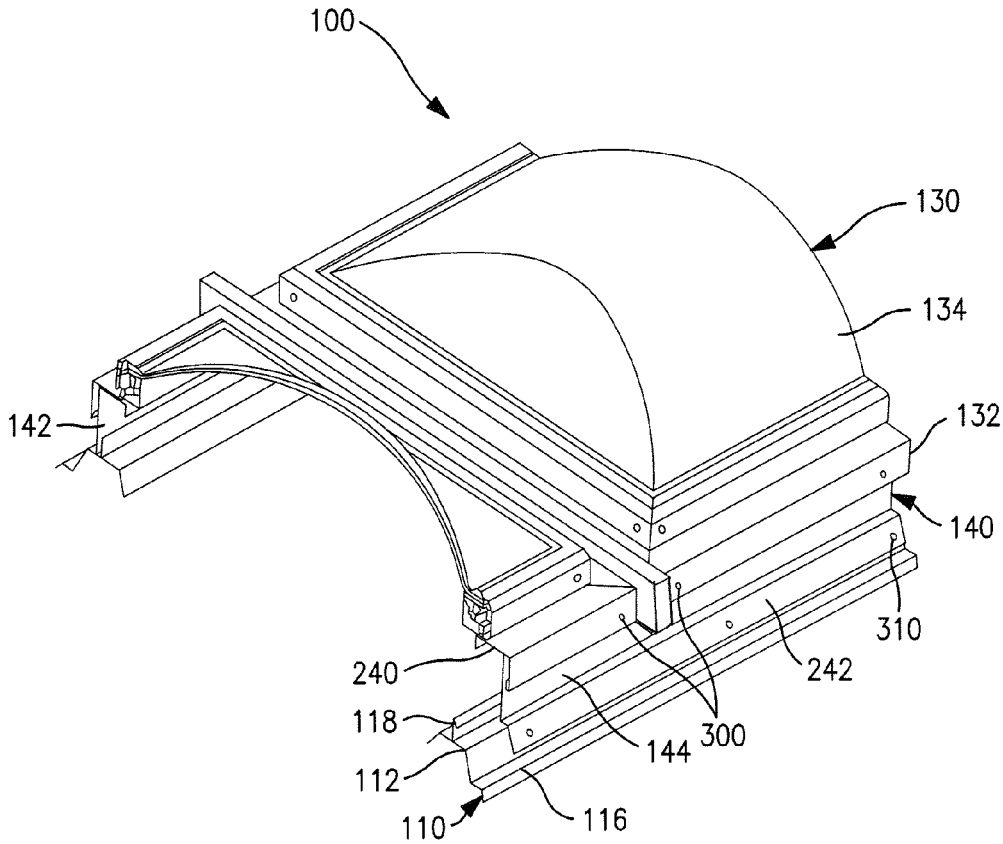
FIG. 16 is a top perspective and partially cut away view of two skylight units installed on the rib elevations of a metal panel roof using a rail mounting system in accordance with the invention, and showing the skylight units joined together to form a run of skylights.
Figure 17:
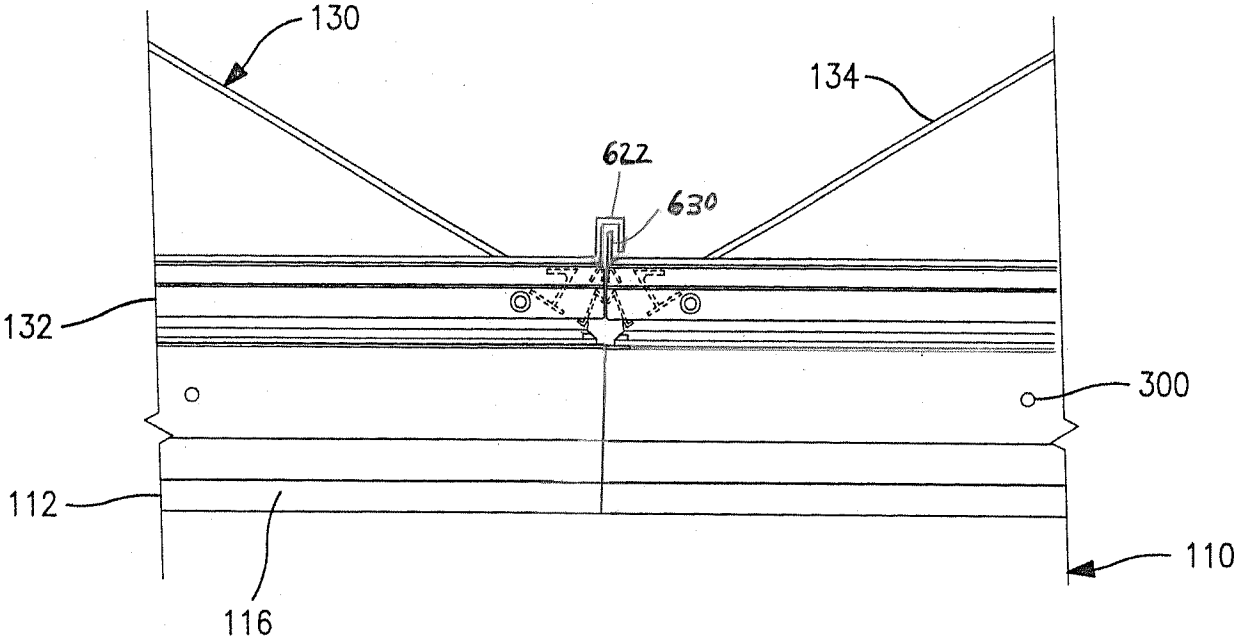
FIG. 17 is a cut-away partial side elevation view of the two skylights, the metal roof, and the side rails of the rail mounting system shown in FIG. 16, showing in greater detail the structure for connecting the two skylights.

Referring now to FIGS. 16 and 17, the adaptation of the system for the application of multiple roof penetrating structures, in this case skylights 130, is described. A chief aspect of the skylight and rail mounting system 100 is the reduction in the number of roof penetrations required to provide daylight to the interior of a building structure, as fewer, longer cuts can be made along the roof panels. This minimized number of openings can be maintained along a single roof panel, if desired, with one continuous opening versus many smaller openings permitting an equal or greater amount of ambient light into the building.

In the case of standing seam roofs the system provides the ability to remove only a portion of the bottom flat of the roofing panel. This maintains the structural integrity of the roof in that multiple sections of major panel elevations are not removed, as is done to accommodate a "typical/conventional" curb assembly. There are thus fewer areas where water can potentially infiltrate the skylight system in that the skylight panels can be attached very near the ridge of the building and run to the eave, requiring water to be diverted only once near the ridge of the roof plane and only across one panel flat.

To the limited extent that cutaways are made to the rib elevations, these are made small, on the order of a few inches or less in length, and solely for the purpose of allowing drainage past the skylights.

The rail mounting system 140 is particularly useful for continuous runs of skylights end to end. FIGS. 16 and 17 show how two adjacent skylights can be mounted to a standing seam panel roof 110 using a skylight and the rail mounting system in accordance with the invention. Instead of using upper end diverters and lower end closures where adjacent skylights abut, in the skylight strip embodiments illustrated in FIGS. 16 and 17, each skylight frame 132 has a female end having an upstanding, downwardly opening, female member 622, typically extending across the full width of the respective end of the skylight frame, and a male end having an upstanding male member 630 extending, optionally intermittently, across the respective end of the skylight frame. End-to-end width of the male member across the width of the skylight frame is less than the width of female member 622 such that the female member of a next adjacent, typically relatively up-slope disposed skylight frame, in a strip of such skylights, can fit over the male member 630 of the next adjacent skylight frame in the strip as the skylight frames abut each other end to end.

As only one example, skylights can be produced in units of up to 10 feet long, and connected in this fashion for as long a strip assembly as is desired or necessary, with each skylight unit being supported by the primary rib elevations of the panel roof. The lengths of the rib elevations extend along the entire lengths of the side rails of the skylight and rail mounting system, whether one skylight is used, or a number of skylights are used end to end. No water can enter over the tops of the side rails of the rail mounting system or enter the top end or bottom end of a such strip of skylights.

The standing rib elevations are shown underlying and in continuous contact with the side rails, providing continuous underlying support to the rails along the entireties of the lengths of the rails.

Where it is desired that the skylight starts at the ridge of the roof, a simple flashing can be inserted under the ridge cap.

Where the ridge cap has a configuration to fit the rib elevations (major corrugations) in the roofing panels, a portion of one rib may be cut out (approximately 2"), allowing the water from the roof panel relatively upwardly on the roof, of the skylight, to be diverted on to the next panel.

If desired, a simple side rail height extension can be used to increase the height or distance between the skylight frame and the roof panel, and can be adapted to simply lie over or attach to the top of the rail mounting system. Such an extension can be produced to rest along the upper flange of the rail mounting system to effectively raise the height of the skylight or smoke vent to accommodate different skylight/smoke vent depths or other design features, or to accommodate snow conditions and the like. In this fashion, the rail mounting system can be produced to a standard height, with varying extensions used to elevate the overall height of the structure for such varied purposes. Various forms for such an extension will be suitable, and the skilled artisan will understand various ways and means of designing and manufacturing these to accomplish the goal of added height to the skylight.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

Those skilled in the art will now see that certain modifications can be made to the apparatus and methods herein disclosed with respect to the illustrated embodiments, without departing from the instant invention. And while the invention has been described above with respect to certain embodiments, it will be understood that the invention is adapted to numerous rearrangements, modifications, and alterations, and all such arrangements, modifications, and alterations are intended to be within the scope of the appended claims.

To the extend any of the following claims use means plus function language, it is not meant to include there, or in the instant specification, anything not structurally equivalent to what is shown in the embodiments disclosed in the specification.

The invention claimed is:

1. A rail mounting system for mounting a load on a metal panel roof, where such roof has panel flats, and rib elevations extending upwardly from the panel flats, said rail mounting system comprising:

first and second side rails for mounting on respective ones of the rib elevations, and thereby supporting opposing sides of such load, a given said side rail having a length and comprising an upstanding riser portion, an upper flange extending from said upstanding riser portion, and a bottom shoulder structure extending from said upstanding riser portion, said bottom shoulder structure having a first surface facing in a direction having a downwardly-facing vector, and a second opposing surface, the first surface being embodied in a first shoulder panel (242*a*) extending laterally away from said upstanding riser portion, a second shoulder panel (242*b*) extending from the first shoulder panel, in a different downward direction.

2. A rail mounting system as in claim 1 wherein said side rail has a length and a thickness, and wherein said second shoulder panel (242*a*) comprises an elongate first mating surface which can mate with, and be mounted to, a shoulder incline on a respective such rib elevation.

3. A rail mounting system as in claim 2 wherein a said side rail is configured such that only one side of a such rib elevation of such metal panel roof can underlie, and mate with, the bottom shoulder structure of the respective said side rail.

4. A rail mounting system as in claim 2 wherein the elongate first mating surface on said side rail can mate with, and be mounted to, such shoulder incline on such rib elevation, along substantially the entire length of the respective said side rail.

5. A rail mounting system as in claim 4 wherein the first mating surface has a width greater than the thickness of the respective said side rail.

6. In combination, a metal panel roof comprising a plurality of elongate metal roof panels, arranged side by side, such roof panels having lengths, first and second edges of adjacent such roof panels meeting at first and second elevated rib structure portions thereof, such elevated rib structure portions collectively defining elevated roof panel ribs, and a rail mounting system as in claim 1 mounted to ones of said ribs.

7. A building, comprising:

(a) a building structural support system; and (b) a metal panel roof, having a rail mounting system thereon as in claim 6.

8. A rail mounting system on a sloping metal roof of a building, for supporting an overlying load from such roof, such sloping metal roof comprising a plurality of elongate metal roof panels arranged side by side, such roof panels having lengths, first and second edges of adjacent such roof panels meeting at first and second elevated rib structure portions thereof, such elevated rib structure portions collectively defining elevated roof panel ribs having lengths extending in a first direction, such rib structure portions of a given said rib comprising first and second rib shoulder elements extending up from the panel flats of the respective roof panels, and standing seam elements extending up from the respective shoulder elements, a given shoulder element comprising a shoulder incline (16*a*) extending up from the panel flat, and a shoulder flat (16*b*) extending laterally from the shoulder incline, said rail mounting system comprising first and second side rails having lengths extending in the same direction as the lengths of such ribs, a given said side rail comprising an upstanding riser wall (113) having a top and a bottom, an upper flange (240) extending laterally from a top portion of said riser wall and providing a supporting interface for supporting such overlying load, and a bottom shoulder structure extending from a bottom portion of said riser wall, said bottom shoulder structure comprising a first shoulder panel (242*a*) extending laterally from said riser wall and interfacing with the shoulder flat (16*b*) of the given rib shoulder element, and a second shoulder panel (242*b*) extending downwardly from said first shoulder panel (2425) and interfacing with the shoulder incline (16*a*) of the given rib shoulder element, a plurality of rivets being spaced along the length of the given said side rail and extending through both said downwardly-extending second shoulder panel (242*b*) of the given said side rail and through the interfacing shoulder incline (16*a*) of the given rib element, and thus securing the given said side rail to the underlying rib at the second shoulder panel of the bottom shoulder structure and the shoulder incline of the given rib element.

9. A rail mounting system as in claim 8, said second shoulder panel of said side rail having a longitudinally-extending distal edge extending along the length of said side rail, such distal edge being disposed above, and displaced from, the respective panel flat.

10. A metal panel roof having a rail mounting system as in claim 8 mounted thereon.

11. A building, comprising:

(a) a structural support system; and (b) a metal panel roof as in claim 10.

* * * * *